US006993846B2

(12) United States Patent
Orloff

(10) Patent No.: US 6,993,846 B2
(45) Date of Patent: Feb. 7, 2006

(54) LUBRICATING STRIP

(75) Inventor: Glennis J. Orloff, Woodbridge, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 147 days.

(21) Appl. No.: 10/382,236

(22) Filed: Mar. 5, 2003

(65) Prior Publication Data

US 2003/0208915 A1 Nov. 13, 2003

Related U.S. Application Data

(60) Provisional application No. 60/379,172, filed on May 8, 2002.

(51) Int. Cl.
*B26B 21/44* (2006.01)

(52) U.S. Cl. ..... 30/41; 424/73; 525/206; 525/207

(58) Field of Classification Search ..... 30/41; 424/73; 525/166, 206, 207
See application file for complete search history.

(56) References Cited

U.S. PATENT DOCUMENTS

| | | | | |
|---|---|---|---|---|
| 4,638,045 | A | 1/1987 | Kohn et al. | |
| 4,757,128 | A | 7/1988 | Domb et al. | |
| 4,789,724 | A | 12/1988 | Domb et al. | |
| 4,875,287 | A | 10/1989 | Creasy et al. | |
| 4,975,280 | A | 12/1990 | Schacht et al. | |
| 5,336,505 | A | 8/1994 | Ng et al. | |
| 5,442,033 | A | 8/1995 | Bezwada | |
| 5,474,780 | A | 12/1995 | Chang | |
| 5,589,545 | A * | 12/1996 | Ramachandran et al. | 525/184 |
| 5,629,009 | A | 5/1997 | Laurencin et al. | |
| 5,760,118 | A * | 6/1998 | Sinclair et al. | 524/306 |
| 5,914,295 | A | 6/1999 | Hoffmann et al. | |
| 6,568,082 | B2 * | 5/2003 | Pouettre et al. | 30/41 |
| 2002/0020065 | A1 * | 2/2002 | Tseng | 30/41 |

FOREIGN PATENT DOCUMENTS

| | | |
|---|---|---|
| JP | 05 177561 | 7/1993 |
| WO | WO 01/60573 A1 | 8/2001 |

OTHER PUBLICATIONS

Modern Plastics Handbook/Modern Plastics, Ed. Charles Harper, McGraw-Hill, 1999, pp. 12.97, 12.98.*
Database WPI, Section Ch, Week 199532, Derwent Publications Ltd., London, GB; AN 1995-243723, XP002245277.
Trznadel M., "Biodegradable Polymer Materials", Internatinal Polymer Science and Technology, Rapra Technologies, Shropshire, GB, vol. 22, No. 12, Dec. 1, 1992, pp. T-58-T-65, XP 000583796.

* cited by examiner

*Primary Examiner*—David W. Wu
*Assistant Examiner*—Satya B. Sastri
(74) *Attorney, Agent, or Firm*—Michaud-Duffy Group LLP

(57) ABSTRACT

The invention provides a lubricating strip for use in wet shaving systems which strip comprises a biodegradable polymer, preferably a surface-eroding, non bulk-eroding biodegradable polymer.

9 Claims, No Drawings

LUBRICATING STRIP

CROSS-REFERENCE TO RELATED APPLICATIONS

This application is entitled to the benefit of and incorporates by reference essential subject matter disclosed in Provisional Patent Application No. 60/379,172 filed on May 8, 2002 in the name of Warner-Lambert Company.

FIELD OF THE INVENTION

The present invention relates to a lubricating strip for use in wet shaving systems.

BACKGROUND OF THE INVENTION

The use of lubricating strips in wet shaving systems is generally well known. Such lubricating strips typically exude lubricants, such as polyethylene oxide, from a plastic matrix that normally remains intact throughout the operational life of the razor. See, for example, U.S. Pat. Nos. 5,454,164, 4,872263, and 4,170,821, the disclosures of which are incorporated herein by reference in their entirety. The lubricant exuded from the plastic matrix allows the razor blade to glide with greater ease along the surface of the skin of the user thereof, thereby reducing the resistance, i.e., drag, of the razor on the skin. The amount of polyethylene oxide lubricant that exudes from the matrix is generally a function of, inter alia, the permeability of the release matrix and the specific diffusion properties of the polyethylene oxide lubricant. Consequently, the amount of polyethylene oxide available at the surface of the polymer matrix for application to the razor blade gradually decreases over the operational lifetime of the lubricating strip. Furthermore, hydrogel lubricating strips, which swell in the presence of water thereby forming channels through which the lubricant diffuses to the surface of the strip, are also known. See, for example, U.S. Pat. Nos. 5,626,154 and 4,875,287, the disclosures of which are incorporated herein by reference in their entirety. By virtue of the swelling of the hydrogel material, the diffusion process is augmented, however, the amount of lubricant arriving at the surface of the strip, although fairly consistent at the beginning of use, is still limited by diffusion characteristics, and the amount of lubricant available once again decreases slowly over time.

The instant invention provides a lubricating strip comprising a biodegradable polymer, preferably a surface-eroding non bulk-eroding biodegradable polymer, for the delivery of polyethylene oxide, or any other lubricant, additive, or adjuvant useful in wet shaving systems. Because the polymer comprising the lubricating strip gradually erodes at a controlled rate with each razor stroke, the lubricating strip comprising such biodegradable polymer, or such preferred surface-eroding, non bulk-eroding biodegradable polymer, provides a fresh consistent amount of lubricant to the skin of the user throughout the operational life of the razor.

SUMMARY OF THE INVENTION

The invention provides a lubricating strip for use in wet shaving systems which strip comprises a biodegradable polymer, preferably a surface-eroding, non bulk-eroding biodegradable polymer.

DETAILED DESCRIPTION OF THE INVENTION

The present invention provides a lubricating strip for use in wet shaving systems which comprises a biodegradable polymer, preferably a surface-eroding, non bulk-eroding biodegradable polymer. Biodegradable polymers decompose or disintegrate in the presence of water or biological fluids and are known to have utility in the delivery of certain bioactive factors, i.e., drugs, and the like. The preferred surface-eroding, non bulk-eroding biodegradable polymers typically comprise a hydrophobic backbone with hydrolytic linkages that promote polymeric erosion upon exposure to water, or other biological fluids, at a controlled rate. Typically, the bioactive factor is incorporated into the biodegradable polymeric matrix, and is subsequently released upon the degradation thereof.

Any biodegradable polymer, including the preferred surface-eroding, non bulk-eroding biodegradable polymers, wherein the polymeric degradation products thereof are: (a) toxicologically compatible with both the dermis of the user thereof, and with the environment; (b) chemically compatible with the lubricant and any additional components, additives, or adjuvants comprising the lubricating strip; and (c) possess the appropriate physicochemical attributes rendering it amenable to, and/or compatible with, the requisite manufacturing processes (e.g., compression, extrusion, injection molding, or solvent casting) necessary for the conversion thereof into the form of a lubricating strip, may be utilized in the practice of the present invention.

In a preferred aspect of the invention, the biodegradable polymer comprises a non-bulk eroding biodegradable polymer. A bulk-eroding biodegradable polymer is characterized by uncontrolled erosion that occurs in addition to, or in place of, surface erosion, which bulk erosion results in degradation of the polymeric matrix with concomitant uncontrolled release of any additional components that are physically incorporated, encapsulated, or otherwise entrained within such matrix. Biodegradable polymers that undergo bulk or uncontrolled erosion are not preferred in the practice of the instant invention.

In another preferred aspect of the present invention, the biodegradable polymer comprises a surface-eroding, non bulk-eroding biodegradable polymer. Generally preferred surface-eroding, non bulk-eroding biodegradable polymers useful in the practice of the instant invention comprise those polymers selected from the group consisting of polyanhydrides, and the co-polymers thereof, polycarboxylic acids, and the co-polymers thereof, and polyorthoesters, and the co-polymers thereof. Where the preferred surface-eroding, non bulk-eroding biodegradable polymers comprise co-polymers, e.g., a polymer in which two or more monomers are combined, such co-polymers may comprise co-polymeric subunits that are random (monomeric subunits located randomly in the co-polymer), block (elongate sequences of different repeating subunits), or alternating (monomeric sequences of one type joined to monomeric sequences of a second kind).

The generally preferred polyanhydride polymers, and the co-polymers thereof, will be generally well known to one of ordinary skill in the art. Heretofore, such polyanhydride polymers, and the co-polymers thereof, have demonstrated utility in drug delivery systems where degradation of the polymeric matrix results in a steady rate of release of the therapeutant to the subject being treated over a desired, or pre-determined, length of time without concomitant deterioration of such therapeutant. See, for example, U.S. Pat. Nos. 5,629,009, 5,545,409, and 4,891,225, the disclosures of which are incorporated herein by reference. Such polyanhydride polymers, and the co-polymers thereof, are generally hydrophobic in nature, are generally capable of incorporating a diverse range of organic and inorganic substrates, and typically degrade at a rate that is dependent upon the ratio of monomers comprising the polymer. In the case of polyanhydride co-polymers, the ratio of co-polymeric subunits determines the degradation rate. For example, where sebacic acid comprises the co-polymer, the greater the number of sebacic add subunits, the faster the rate of degradation.

Preferred polyanhydrides that are useful in the practice of the invention comprise poly[bis(p-carboxyphenoxy)propane anhydride], poly-bis(p-carboxyphenoxy)methane, poly [bis (p-carboxyphenoxy)methane anhydride], poly(p-carboxyphenoxy)hexane anhydride, and their co-polymers with other substances, including, for example, sebacic acid, and/or fatty acid dimers. One generally preferred co-polymer that is useful in the practice of the present invention is poly[1,3-bis(carboxyphenoxy)propane-co-sebacic acid]. The preferred polyanhydride polymers, and the co-polymers thereof, may be prepared as disclosed in U.S. Pat. No. 4,789,724, the disclosure of which is incorporated herein by reference.

The generally preferred polycarboxylic acid polymers, and the co-polymers thereof, will also be generally well known to one of ordinary skill in the art. Generally, polycarboxylic acid polymers are hydrophobic in nature and, in a relatively basic environment, i.e., a pH in a range of from about 6 to about 9, such polymers begin to erode. The erosion rate of polycarboxylic acid polymers generally dependent upon the number of carboxylic acid residues present in the polymer, i.e., the larger the number of such residues, the slower the rate of polymeric erosion.

The generally preferred polyorthoester polymers, and the co-polymers thereof, will also be generally well known to one of ordinary skill in the art. Heretofore, such polyorthoester polymers, and the co-polymers thereof, have demonstrated utility in drug delivery systems where degradation of the polymeric matrix provides a uniform rate of release of a therapeutant to the subject being treated over a desired, or pre-determined, length of time without concomitant degradation of such therapeutant. Examples of such polyorthoesters employed in drug delivery systems are disclosed in, inter alia, U.S. Pat. Nos. 5,336,505 and 5,461,140, the disclosures of which are incorporated herein by reference. Additional, exemplary polyorthoesters comprising orthoester repeating units and a hydrocarbon radical are disclosed in, inter alia, U.S. Pat. No. 4,119,579.

Additional preferred embodiments of the lubricating strip of the present invention comprising biodegradable polymers having controlled rates of erosion are disclosed herewith. Such additional preferred polymers are selected from the group consisting of amino acid polymers, and poly(aminoacidester)phosphazenes.

The additionally preferred amino acid polymers will also be well known to one of ordinary skill in the art. Examples of such amino acid polymers are disclosed in, for example, U.S. Pat. No. 4,638,045, the disclosure of which is incorporated herein by reference. Generally, this class of polymers comprises polymers having a plurality of hydrolytically active sites, and the rate of degradation of these polymers is dependent upon number and type of amino add residues comprising the polymer.

The additionally preferred poly(aminoacidester)phosphazene polymers may be prepared, for example, as disclosed in U.S. Pat. No. 4,975,280, the disclosure of which is incorporated herein by reference. A generally preferred poly(aminoacidester)phosphazene, useful in the practice of the present invention and which may be prepared as disclosed in the aforementioned U.S. Pat. No. 4,975,280, comprises poly-bis(ethylglycino)phosphazene.

Additional polymers useful in the practice of the present invention comprise homo- and copolymers of (α)-hydroxy-fatty acids comprising 2 to 16 carbon atoms, starch polymers, polyliginins, polychitins, cellulose polymers, and hydrophobic polymers selected from the group consisting of polyhydroxybutanoic acid, and polyhydroxybutanoic acid/hydroxyvaleric acid co-polymers.

The biodegradable polymer, including the preferred surface-eroding, non bulk-eroding biodegradable polymers, comprising the lubricating strip of the invention further comprises a lubricant. Any conventional lubricant, lubricating additive, or adjuvant that is useful in wet shaving systems, and chemically compatible with the biodegradable polymer comprising the lubricating strip, may be employed in accordance with the present invention. It is normally preferred that the lubricant, additive or adjuvant, be dispersed uniformly in the polymeric matrix such that a controlled release thereof is maintained therefrom. Although the lubricant is normally physically incorporated, encapsulated, or otherwise entrained within the polymeric matrix, it is to be understood that the lubricant, where desirable or appropriate, may also be incorporated into the monomeric subunit, or subunits, comprising the specific polymer or co-polymer, thereby becoming part of the polymeric structure. In such a structure, the lubricant is subsequently released to the dermis of the user upon gradual degradation of the polymer. Exemplary conventional lubricants useful in the practice of the invention may comprise, for example, cyclomethacone, polyethylene oxide, and the like. Polyethylene oxide is a generally preferred lubricant.

It is to be further understood that the lubricant, lubricating additive, or adjuvant may, where desired or appropriate, be combined together in the polymeric matrix with conventional dermal conditioners, fluids, or similar ingredients useful in wet shaving systems including, for example, lanolins, oils, moisturizers, emollients, and the like. Additional ingredients, may comprise, for example, (1) skin health-related ingredients such as dermatologic agents (acne, flaky, itchy), balancing agents (dry or oily skin, pH correct, moisturizers, seasonal solution), rejuvenation/revitalization agents (vitamin therapy, herbal, conditioners, acids, cell renewal), cleansing agents (antibacterial, natural, hypoallergenic, botanical-derived, fragrant or fragrance free), or skin-protective agents (UV, anti-aging, anti-wrinkle); (2) skin sensation agents such as menthol, or pain-relief (aspirin); (3) soothing agents including neosporin; (4) hair treating agents such as beard softeners, hair growth inhibitors, hair outer layer degradants, hair hydrating agents, hair conditioners, or hair thinning agents; (5) cosmetics such as tanning agents; (6) aromatherapeutants including perfumes or essences; and (7) other agents such as oil, milks, honey, gels, creams, balms, catalysts, or effervescents.

What is claimed is:

1. A lubricating strip for use in a wet shaving system which comprises a biodegradable polymer, wherein said polymer is selected from the group consisting of polyanhydrides, and the co-polymers thereof, polycarboxylic acids, and the co-polymers thereof, and polyorthoesters, and the co-polymers thereof, and wherein said polyanhydride polymer is selected from the group consisting of poly [bis(p-carboxyphenoxy)propane anhydride], poly-bis(p-carboxyphenoxy)methane, poly[bis(p-carboxyphenoxy)methane anhydride], and poly(p-carboxyphenoxy)hexane anhydride, and the co-polymers thereof.

2. A lubricating strip according to claim 1, wherein said biodegradable polymer comprises a non-bulk eroding biodegradable polymer.

3. A lubricating strip according to claim 1, wherein said biodegradable polymer comprises a surface-eroding non bulk-eroding biodegradable polymer.

4. A lubricating strip according to claim 1, which further comprises a lubricant.

5. A lubricating strip according to claim 4, wherein said lubricant is incorporated into a monomer, or monomers, comprising said biodegradable polymer.

6. A lubricating strip according to claim 4, wherein said lubricant is selected from the group consisting of polyethylene oxide and cyclomethacone.

7. A lubricating strip according to claim 6, wherein said lubricant comprises polyethylene oxide.

8. A lubricating strip according to claim 4, wherein said polyanhydride co-polymer with sebacic acid is poly[1,3-bis (carboxyphenoxy)propane-co-sebacic acid].

9. A lubricating strip for use in a wet shaving system which comprises a biodegradable polymer, wherein said polymer is selected from the group consisting of polyanhydrides, and the co-polymers thereof, polycarboxylic acids, and the co-polymers thereof, and polyorthoesters, and the co-polymers thereof, and wherein said polyanhydride co-polymer comprises a polyanhydride co-polymer with sebacic acid or a fatty acid dimer.

* * * * *

UNITED STATES PATENT AND TRADEMARK OFFICE

CERTIFICATE OF CORRECTION

PATENT NO. : 6,993,846 B2
DATED : February 7, 2006
INVENTOR(S) : Glennis J. Orloff It is certified that error appears in the above-identified patent and that said Letters Patent is hereby corrected as shown below:

Column 6,
Line 1, delete claim 8 and substitute:
-- 8. A lubricating strip for use in a wet shaving system which comprises a biodegradable polymer, wherein said polymer is poly[1,3-bis(carboxyphenoxy)propane-co-sebacic acid]. --.
Line 4, delete claim 9 and substitute:
-- 9. A lubricating strip for use in a wet shaving system which comprises a biodegradable polymer, wherein said polymer is selected from the group consisting of polyanhydrides and polyorthoesters. --.

Signed and Sealed this

Sixteenth Day of May, 2006

JON W. DUDAS
*Director of the United States Patent and Trademark Office*